United States Patent [19]

Chierici et al.

[11] 4,155,507

[45] May 22, 1979

[54] TIE PLATE ARRANGEMENT FOR RAILROAD TRACK

[75] Inventors: Osvaldo F. Chierici, Elmhurst; Richard F. Murphy, Aurora, both of Ill.

[73] Assignee: Holland Company, Lombard, Ill.

[21] Appl. No.: 861,998

[22] Filed: Dec. 19, 1977

[51] Int. Cl.[2] ..... E01B 9/40

[52] U.S. Cl. ..... 238/287; 238/280; 238/304; 238/306; 238/307

[58] Field of Search ..... 238/275, 283, 287, 290, 238/291, 304, 307, 306, 280

[56] References Cited

U.S. PATENT DOCUMENTS

| | | | |
|---|---|---|---|
| 2,094,279 | 9/1937 | Moses | 238/283 |
| 2,867,384 | 1/1959 | Toulmin, Jr. | 238/283 |
| 2,996,256 | 8/1961 | Moses | 238/283 |
| 3,268,170 | 8/1966 | Moses | 238/283 |
| 3,358,925 | 12/1967 | Pennino et al. | 238/287 |
| 3,544,006 | 12/1970 | Pennino | 238/287 |

*Primary Examiner*—L. J. Paperner
*Assistant Examiner*—Ross Weaver

[57] ABSTRACT

A tie plate for mounting railroad track rails on track ties in which the tie plate is formed from a corrosion resistant resilient polymer of dry self-lubricating characteristics, in which the tie plate has its upper side shaped to define along either side of the plate bearing surface to be engaged by the rail base a pair of flexible ridges each defining a flexible lip, with such lips opposing each other and terminating in a marginal edge projecting over the tie plate bearing surface. The tie plate ridges each define under their respective lips an upstanding side wall, which side walls oppose each other and are spaced apart and of a height to closely receive the rail base side edges therebetween when the rail is applied to the tie plate. The tie plate ridge lips each define on their upwardly facing sides a cam surface arcing downwardly from the crest of same to the respective lip marginal edges, with the respective lip marginal edges being spaced apart for snap fitting of the rail base between same for effecting seating of the rail base against the tie plate bearing surface. The underside of the tie plate is serrated for biting engagement with the tie as well as providing for aereation of same under the plate. In alternate forms, a separate brace plate extends across the tie plate for engagement with the sides of the tie to eliminate the need for rail anchors.

14 Claims, 9 Drawing Figures

TIE PLATE ARRANGEMENT FOR RAILROAD TRACK

This invention relates to tie plate arrangements for mounting railroad track rails on track ties, and more particularly, to a railroad track tie plate that is especially suitable for use with welded rail.

The familiar conventional tie plate is formed from steel, and is thus subject to corrosion, due to both weathering and exposure to foreign matter debris (from such sources as chemicals, fuels, and lubricating oil base materials carried by train cars) resulting when trains pass over the track. The corrosive nature of conventional steel tie plates also adversely affects the life span of the ties to which they are applied due to rottening of the tie surfacing underlying the tie plate; the corroding metal surfacing of the tie plates in being in physical contact with the wooden surfacing of the ordinary tie tends to accelerate the deterioration of the tie wooden surfacing involved.

Furthermore, the tie plates are subject to considerable stress as the cars of the train pass over them. This is particularly a problem where traffic is heavy, the track bed is not properly maintained, and temperature extremes are regularly experienced. Moreover, the conventional tie plate is heavy and awkward to handle.

A principal object of this invention is to provide a railroad track tie plate that is not only of indefinite useful life, but also provides for snap fitting of the tie plate to the rail base in applying the rails to the track ties.

Another principal object of the invention is to provide a light weight easily handled tie plate especially suited for use in connection with the laying of welded rail, and that provides for adequate aereation of the underlying tie for tie preservation purposes.

Other objects of the invention are to provide a tie plate that has energy absorbing and sound deadening characteristics, provides increased resistance to rail lateral movement tendencies, and that is economical of manufacture, convenient to store and use, and of essentially unlimited life span in terms of being corrosion and weather resistant.

In accordance with the invention, a tie plate is provided that is formed from an ultra high molecular weight polyethylene that is fully weather and corrosion resistant while being resilient and arranged for aereation of the tie to which the plate is applied. The tie plate is especially formed for snap fitting application to the rail base, with the tie plate along each side of its bearing surface (against which the rail base is to seat) being formed with a pair of ridges each defining a lip, with such lips opposing each other and terminating in a marginal edge projecting over the tie plate upper bearing surface. The tie plate spaced apart ridges each define under their lips an upstanding side wall, with such ridge side walls being spaced apart and being of a height to closely receive therebetween the rail base when the rail is applied to the tie plate. The ridge lips each define on their upwardly facing sides a cam surface arcing downwardly from the crest of same to the respective marginal edges, with the indicated lip marginal edges being spaced apart for snap fitting of the rail base between same for seating the rail base against the tie plate upper bearing surface.

The underside of the tie plate is formed to define serrations in the form of angled ridges oriented to extend longitudinally of the rail for biting engagement with the underlying tie surfaces as well as providing for aereation of same.

The track tie is used in connection with welded rail installation by applying the individual tie plates to the ties prior to the rail being laid in place, after which as the rail lengths in ribbon form are laid down in the usual manner. At the individual ties and tie plates carried thereby, as the rail ribbon comes to rest on the tie plate, its base bears against the tie plate lip cam surfaces to cam the tie ridges bearing the lip sidewise of the plate for snap fitting of the rail base between the tie plate lips.

Thereafter the rails may be suitably gauged, with the tie plates moving in conjunction therewith, and the tie plates spiked into place on their supporting ties, using conventional automatic spiking equipment.

The tie plates being corrosion and weather resistant have an essentially unlimited useful life. As the tie plates are made from a material that in addition to being wear resistant is also resilient, the tie plates have energy absorbing and sound deadening characteristics, in addition to providing some cushioning for the rails. The material from which the tie plate is formed is also of dry self-lubricating characteristics which makes for ease in snap fitting of the rails on the plates, and adjusting of the tie plates longitudinally and laterally of the rails.

Other objects, uses, and advantages will be obvious or become apparent from a consideration of the following detailed description and the application drawings.

However, it is to be distinctly understood that the specific drawing illustrations provided are supplied primarily to comply with the requirements of the Patent Laws, and that the invention is suspectible of other embodiments that will be obvious to those skilled in the art, and which are intended to be covered by the appended claims.

Figure 1A:
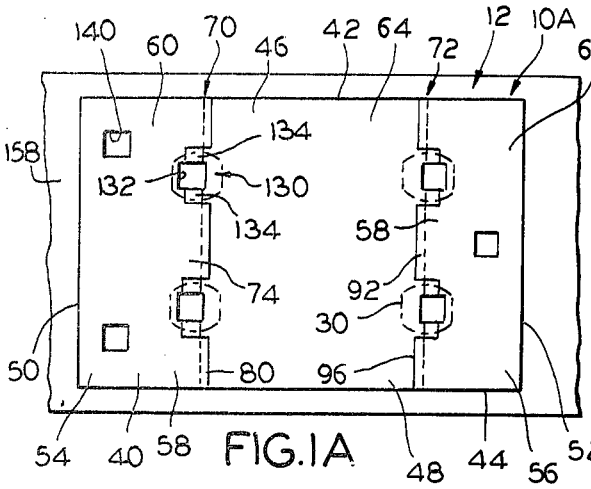
FIGS. 1A and 1B are plan views of tie plates embodying the invention, with the plates differing only in the location and number of spike holes defined by the tie plate, and the plate shown applied to their ties by the usual spikes shown in phantom.
Figure 1B:
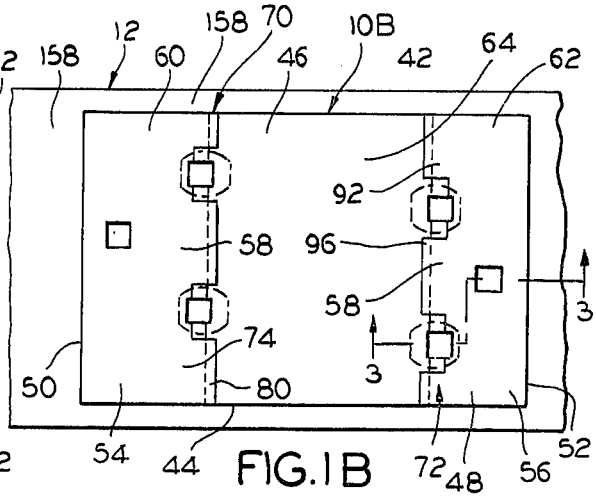

Reference numerals 10A and 10B of FIGS. 1A and 1B, respectively, generally indicate tie plates arranged in accordance with the present invention applied to a conventional wooden track tie 12 for mounting of the familiar track rail 14 on the track ties 12. The tie 12 is assumed to be the standard eight inch wide wood tie commonly used in railroad track, though tie width as such is not a critical aspect of the invention.

The rail 14 has the familiar base 16, web 18, and head (not shown) on which the railroad car wheels ride. The rail base 16 is of the familiar double flanged configuration defining the relatively broad rail undersurface 20 that is to engage the tie plates that mount the rail on the ties 12. The rail base 16 along its side edges 22 and 24 is formed to define the upstanding side surfaces 26 and 28 that extend longitudinally of the rail. As is well known, the rail base side portions 22 and 24 are customarily held to the ties 12 by the application of the familiar railroad spikes 30 thereto. Several of the spikes are shown in phantom in the drawings for illustrative purposes only, and they include the usual head 32 and shank 34 that is driven into the tie 12 in accordance with standard practices, and through the usual spike holes formed in conventional tie plates.

The tie plates 10A and 10B each comprise a generally flat body 40, which in accordance with these embodiments of the invention is of one piece molded construction formed from ultra high molecular weight (UHMW) polyethylene having a molecular weight in the range of from about 3,000,000 to about 9,000,000. In the preferred embodiment of the invention, the bodies 40 are formed from molecularly oriented UHMW polyethylene marketed by Ketrol Enterprises (of York, Penna.) under the trademark TUFLAR (grade PL). This material is suitably shaped to define the body 40, and conforms to the characteristics specified in this application, and thus has, among other things, a high degree of toughness and long wearing characteristics; it is pliable but nonstretchable, and thus is free from distending or stretching characteristics, and it is resilient but sufficiently compaction resistant to resist any substantial compaction under compressive forces up to its elastic limit. Furthermore, the material involved has a high degree of elastic memory for full return to original shape after being stressed, again up to its elastic limit, and the material is also of dry self-lubricating and low coefficient of friction characteristics.

As indicated in FIGS. 1A through 4, the body 40 is of the generally flat configuration indicated and has the familiar quadrilateral marginal outline customary for tie plates. The tie plate body thus defines planar rectilinear end surfaces 42 and 44 at the ends 46 and 48 of same, and planar rectilinear side surfaces 50 and 52 at the sides 54 and 56 of same.

Figure 2:
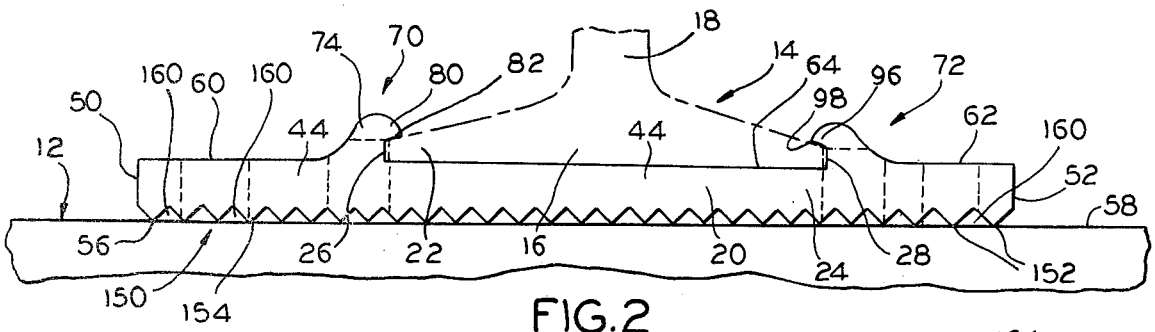
FIG. 2 is an end elevational view of the tie plates of FIGS. 1A and 1B, with the rail base as applied thereto being shown in phantom.
Figure 4:
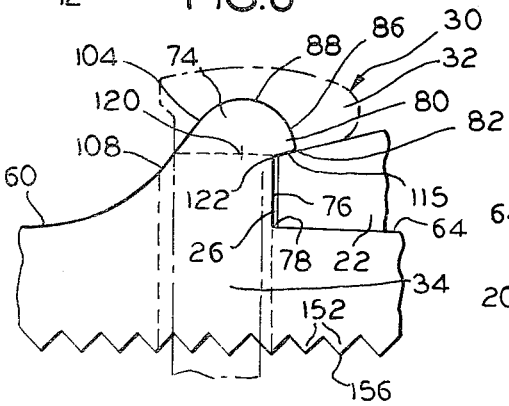
FIG. 4 is a view similar to that of FIG. 3, but is in end elevation form and illustrates the snap action lip on the left hand side of the tie plate and shows in phantom conventional spike as applied to one of the plate holes interrupting the plate ridges.
Figure 3:
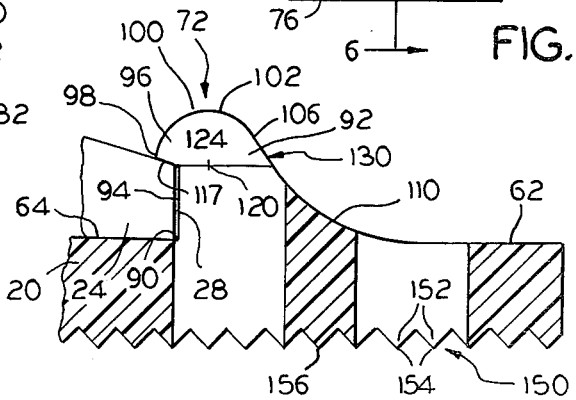
FIG. 3 is an enlarged fragmental sectional view taken substantially along line 3—3 of FIG. 1B, better illustrating the configuration of the tie plate at its right hand snap action lip.

The top surfacing 58 of the body 40 comprises planar side surfaces 60 and 62 which are in coplanar relation and parallel the plane of the body 40. Formed across the length of the tie plate between its end surfaces 42 and 44 is the usual upwardly facing planar bearing surface 64 that is engaged by the rail base undersurface 20 in practice, and which, as is conventional, has the familiar one to forty surfacing sloping that is customary for tie plates to slightly angle the rails of the track so that the flange edge sides of the rail head are slightly tilted towards each other. In the showing of FIGS. 2, 3 and 4, the surface 64 inclines downwardly from the left to the right with this conventional sloping, it being understood that the tie plate supporting the other rail 18 of the track is oriented so that the sloping of the surface 64 is in the opposite direction.

In accordance with the invention, the top surfacing 58 of the body 40 between the tie plate bearing surface 64 and the respective planar surfaces 60 and 62 is formed with ridge structures 70 and 72 which are, in section transversely of the tie plate, of the same configuration the same but oppositely oriented on either side of the plate bearing surface 64.

As indicated more specifically in FIGS. 2, 3 and 4, the ridge structures 70 comprises a ridge 74 extending longitudinally of the body 40 and defining an upstanding side wall 76 that is along the marginal edge 78 of the bearing surface 64. Projecting over the surface 64 is a lip 80 defining a marginal edge 82 that is disposed in overlying relation with respect to the tie plate bearing surface 64.

In accordance with the invention, the upwardly facing surfacing of the ridge 74 is of semicylindrical configuration to define a cam surface 86 that extends at least from the crest 88 of the surface 86 to the lip marginal edge 82.

The ridge structure 72 along the other marginal edge 90 of the plate bearing surface 64 is similarly contoured. Thus, the ridge structure 72 defines ridge 92 having upstanding side wall 94 which opposes side wall 76, lip 96 that opposes the lip 80 and terminates in marginal edge 98, and the cylindrically contoured cam surface 100, which in accordance with the invention, is cylindrically contoured from at least its crest 102 to the marginal edge 98.

In the form shown, the surfaces 86 and 100 have their cylindrical configurations extending over the respective crests 88 and 102 to approximately the positions indicated at 104 and 106 (see FIGS. 3 and 4), respectively, wherein the respective concave surfacings 108 and 110 are employed for a smooth convergence into the respective surfaces 60 and 62.

In accordance with the invention, the side wall surfaces 76 and 94 are proportioned in height and spaced apart spacing to closely receive between same and under the lips 80 and 96 the rail base 16, and specifically its side portions 22 and 24, in the manner indicated in FIGS. 3 and 4.

Furthermore, the ridge structures 70 and 72 are spaced apart such that the rail base 16 when centered with respect to the tie plate bearing surface 64, on being lowered into place on the tie plate, will be between the cam surface crests 88 and 102, so that, as the rail is rested on the tie plate and tie in being laid on the track bed, the rail base side portions 22 and 24 will cam the lips 80 and 86 away from each other, thereby bending or flexing ridges 74 and 92 accordingly, so that the rail base 16 will have snap fit application to the plate bearing surface 64, with the lips 80 and 96 returning to the positions shown in FIGS. 2 through 4 for bearing engagement with the rail base for firm securement of the tie plate to the rail base.

As indicated, the material from which the tie plate body 40 is formed is flexible even though it is nonstretchable, and has a high degree of elastic memory with accompanying resiliency. The lips 80 and 96 thus will return to original position with a snap action as the rail base 16 drops into bearing relation with the plate bearing surface 64, with the lips 80 and 96 being shaped so that respective undersides 115 and 117 will firmly bear against the rail base sides 22 and 24, and especially adjacent the lip edges 82 and 98, under the elastic memory action of the material forming body 40.

As is best indicated in FIGS. 3 and 4, the cylindrically contoured surfacings 86 and 100 are preferably struck about a center 120 on a radius approximating twice the projection of the respective lip marginal edges 82 and 98 beyond the respective side walls 76 and 94 over the surface 64, which centers 120 are at approximately the level of the upper margins 122 and 124 of the respective side surfaces 76 and 94 (that are defined by body 40).

The tie plate body 40 is formed with spike holes in accordance with conventional spike hole location, numbering, and positioning employed for conventional tie plates, except that the spike holes for the spikes that are to bear against the rail base 16, the ridge structures 70 and 72 are interrupted as at 130 to define square openings 132 that extend through the body 40, and in the area of the respective lips 80 and 96, the ridges 74 and 92 are shaped to define level surfaces 134 on either side of the spike holes 132 to accommodate a nesting of the spike heads 32 within the lips 74 and 92 for bearing engagement with the rail base 16 free of engagement with body 40, as indicated in FIG. 4.

The body 40 is formed with square spike holes 140 formed in its side portions 54 and 56 for spiking the tie plate to the tie.

Further in accordance with the invention, the underside 150 of the plate body is shaped to define serrations 152 in the form of right angled ridges 154 that extend longitudinally of the tie plate and parallel its bearing surface 64. The right angled ridges 154 at their apexes 156 define angled corners that are adapted for firm biting engagement with the top surfacing 158 of the tie 12, while defining between the body 40 and the tie plate surfacing 158 a plurality of aereation providing spaces 160 for aereating the portion of the tie under the tie plate.

Assuming that tie plates corresponding to tie plates 10A or 10B are to be employed in connection with welded rail, after the ties 12 have been put in place or existing rails and tie plates have been removed to expose existing ties for rerailing purposes, the individual tie plates of the invention are distributed along the ties where the rails are to be laid. Welded rail in ribbon form is then laid down on the track bed using equipment suitable for this purpose, such as Holland Company's Model D-1085 rail distribution/pick up cars that handle the rails in 1443 foot continuous welded rail lengths; alternately, a system of the type disclosed in Brosnan Brashan U.S. Pat. No. 3,288,082 may be employed. As the individual rails are lowered onto the tie plate bodies 40, the tie plates are centered relative to the rail base so that the rail base makes the indicated camming relationship with the tie plate camming surface 86 and 100 for snap fitting application of the rail base thereto.

Should one side or the other of the rail base 16 not have fully snapped by one of the lips 80 or 96, when the rail lowering is complete, several blows of the spikes hammer against the rail base involved, on either side of the body 40 involved, will complete the camming action necessary to fully seat the base 16 within the tie plate and against the bearing surface 64.

The rails are then properly gauged using conventional gauging equipment, after which the spikes are applied using a conventional automatic spiking machine.

Figure 6:
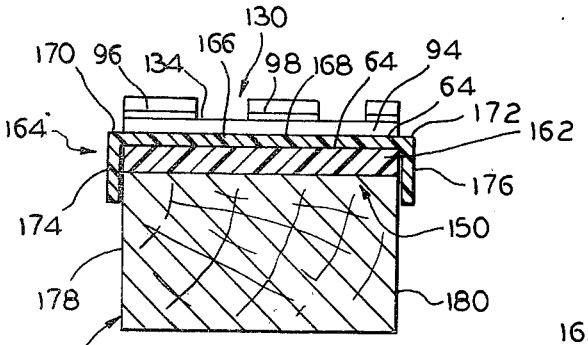
FIG. 6 is a cross-sectional view taken substantially along line 6—6 of FIG. 5.
Figure 5:
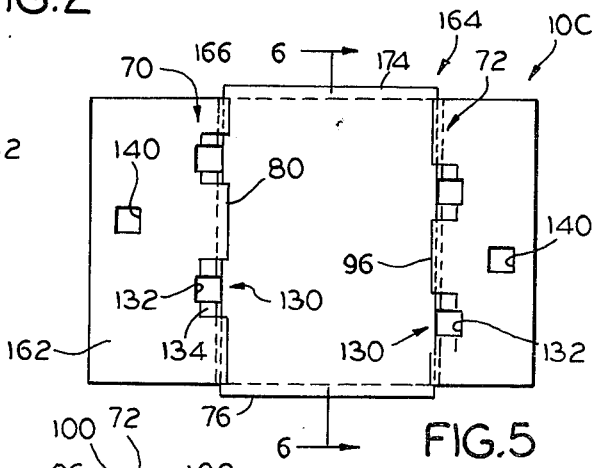
FIG. 5 is a plan view of a modified form of tie plate in accordance with the invention.

Referring now to the tie plate 106 shown in FIGS. 5 and 6, the tie plate 10C comprises a body 162 formed in the same manner as body 40 except that the bearing surface 64 is indented toward the underside 150 of the body 162 to receive retainer plate 164 over the top of the surface 64 in the manner indicated in FIGS. 5 and 6.

The retainer plate 174, which is formed from the same polymer material as body 40, defines a planar panel portion 166 formed with upwardly directed bearing surface 168 that is to be at the same level as surface 64 of the plate body 40. The retainer plate 174 at either end 170 and 172 of same includes the respective angled flange portions or legs 174 and 176 that are intended to closely receive the respective side surfaces 178 and 180 of the tie 12 and serve as tie plate movement restraining abutments to take the place of conventional rail anchors. The tie plate body 162 includes the ridge structures 70 and 72 already described, as indicated by corresponding reference numerals, as well as the indicated spike holes 132 and 140.

The underside 150 of the tie plate body 162 is serrated in the same manner as body 40, and thus is formed to define serrations 152.

Figure 7:
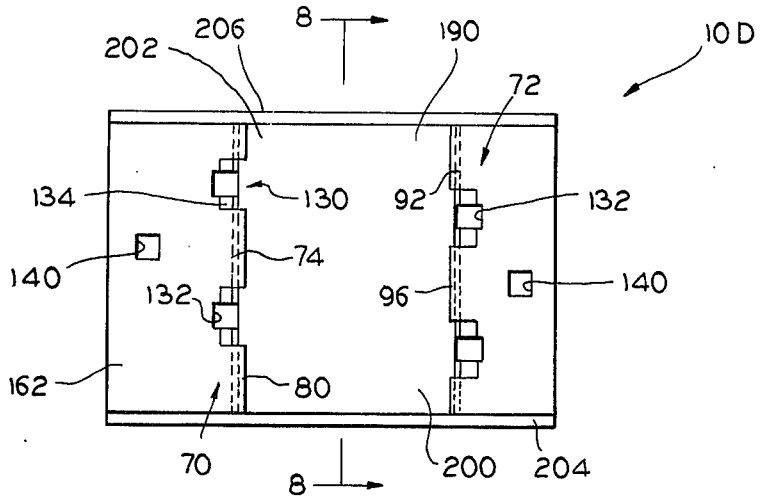
FIG. 7 is a view similar to that of FIG. 5, illustrating another embodiment of the invention.
Figure 8:
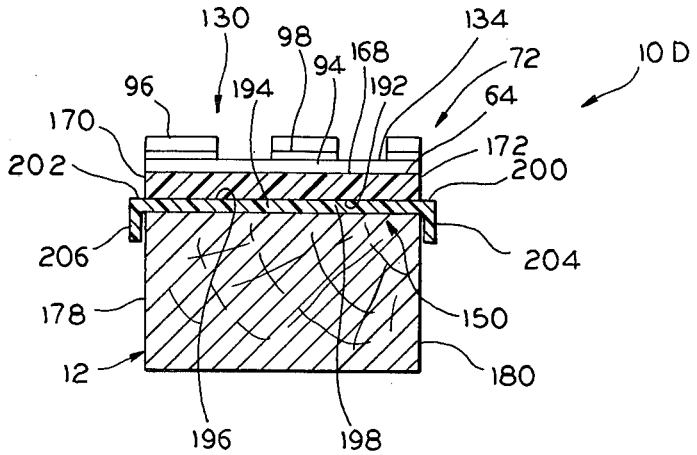
FIG. 8 is a cross-sectional view taken substantially along line 8—8 of FIG. 7.

Referring now to the tie plate 10D shown in FIGS. 7 and 8, tie plate 10D comprises a body 190 that is similar to body 40 but has its underside 192 planar for resting on modified retainer plate 194 on its top surface 196. The retainer plate 194, which is formed from the same polymer material as body 40, defines planar panel portion 198 that has the same width as bodies 40 and 190 and is formed with spike holes corresponding in location to spike holes 132 and 140. Plate 194 at either end 200 and 202 of same includes the respective angled flange portions 204 and 206 that closely receive the respective tie side surfaces 178 and 180 to serve as tie plate movement restraining abutments to take the place of rail anchors. The body 190 includes the ridge structures 70 and 72, but in this instance serrations 152 are omitted though they may be included if so desired.

Retainer plates 174 and 194 may alternately be formed from a steel comparable to that employed for conventional tie plates. As ties conventionally have a nominal eight inch width, their flanges are spaced apart accordingly so that one or the other of each will be disposed in movement restraining engagement with one of the tie sides, depending on the bias applied to the tie plate installation in question due to stresses acting in or on the rails mounted on same.

It will thus be seen that the invention provides a tie plate arrangement having a number of significant improvements.

For instance, the preferred material from which the basic tie plate body is preferably formed is not only resistant to corrosion and weathering, but is also resistant to foreign matter adhering thereto. Consequently, the tie plate of this invention has a useful life of essentially unlimited duration insofar as deterioration due to corrosion, weathering, and impurity accumulations are concerned. The freedom of the tie plate from weathering and corrosion also avoids adversely affecting the tie itself due to these problems, and the aereation of the tie surfacing engaged by the tie plate has obvious beneficial preservative effects in this area of the tie.

The polyethylene material employed for making the tie plate of the invention has a weight of about ⅛th of that of steel (assuming tie plates of corresponding dimensions), which, of course, greatly increases the handability of the tie plate for storage and application pruposes.

The dry self-lubricating characteristics of the material and its high degree of elastic memory makes for easy snap fitting of the rail base onto the tie plate bearing surface with positive return of the tie plate ridges and hold down lips to initial position for firm gripping of the rail base embraced by same; the rail at each tie plate location is held embraced by the tie plate, with the tie plate remaining in place even though the spikes that have been applied to same become dislodged in service use. This insures that the weight supported by the rail continues to be spread over the tie area covered by the tie plate involved. Conventional tie plates, when spikes become dislodged, can separate from the rail and even be pitched away from the tie due to air action accompanying passing trains, leaving the rail to bear directly against the tie.

The high degree of toughness of the preferred material for making the tie plates of this invention, and its resilient nature makes for excellent wear resistance and provides beneficial sound deadening effects due to the energy absorbing characteristics involved. The rail is also provided with a cushioning effect as cars pass over the ties involved; this, together with the load bearing area provided by the plate on the tie, alleviates tie crushing problems.

The preferred material has a coefficient of friction of about 0.02 that thus insures easy snap fitting of the rail within the tie plate. Movements of the rail longitudinally of the track relative to the tie plates, due to thermal expansion and contraction, and the like have no wearing effect on the tie plate at the location of its bearing surface 64 and side surfaces 76 and 94, due to the wear resisting nature of the material involved.

Metal worn off the rail at the tie plates and any foreign matter that is caught between the rail base and the tie plate becomes embedded in the tie plate surfacing 74, and thus is positioned to avoid any wearing action on the rail wear surfaces involved. As indicated, since the material from which the tie plate is preferably made resists adherence thereto of foreign matter, such foreign matter does not accumulate on the tie plate where it is exposed, and it is only grit and the like that may become trapped between the tie plate surfacing and the rail surfaces it engages that is subject to the foreign matter embedding action indicated.

The serrations 152 defined by the tie plate underside bite into the top surfacing of the tie to offer firm resistance against shifting of the rail laterally of the bed, especially on curves due to expansion and contraction due to temperature variations.

The tie plate bodies in accordance with the invention remain attached to the rails even after spike removal or dislodgement. Shifting of the rails for regauging or initial gauging, with the tie plates attached, is easy as the tie plates readily ride along the tie surfacing. The plates also may be readily shifted longitudinally of the rail by taping at the ends of the plate as needed. The plates are readily separated from the rails by striking them off, from the top sides of same, when the rail is separated from the tie.

As already indicated with regard to the embodiment of FIGS. 5–8, the retainer plates 164 and 194 provide the additional advantage of eliminating the need for rail anchors on either side of the tie.

While the tie plates of this invention are preferred for use with welded rails, it will be apparent that they are readily usable with ordinary rail of standard lengths.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the inention.

We claim:

1. In a tie plate for mounting railroad track rails on track ties, said plate comprising a generally flat body of quadrilateral outline having an upper rail engaging side, a lower tie engaging side, and a plurality of spike receiving holes for spiking the plate to the tie, the improvement wherein:

said body is formed from a dry self-lubricating pliable polymer material that is distension free, said body along the upper side of same being formed to define a bearing surface extending thereacross for receiving the rail base thereagainst, said body along either side of said bearing surface defining a pair of opposed rail base gripping lips overhanging said surface and each terminating in a marginal edge projecting over said bearing surface, said lips being at a level above said surface for close fitting overlying relation to the rail base side edges when the rail base engages said body surface, said lips each defining across their upwardly facing sides a convexly contoured cam surface arcing from the crest thereof above said bearing surface downwardly into the respective lip marginal edges, said lip marginal edges being spaced apart across said bearing surface for snap fitting of the rail base by same for seating the rail base against said bearing surface said cam surfaces being struck in a radius of approximately twice the distance said lip edges project over said body bearing surface and centered in approximate vertical alignment with the respective cam surface crests and approximately at the level of the upper ends of said ridge side walls.

2. In a tie plate for mounting railroad track rails on track ties, wherein the rail has a base of predetermined width defining a planar under bearing surface extending the width of the rail base and an upright side edge surface along either side of the base of predetermined height, said tie plate comprising a generally flat body having an upper rail engaging side, a lower tie engaging side, and a plurality of spike receiving holes for spiking the tie plate to the tie, the improvement wherein:

said body is formed from a dry self-lubricating pliable polymer material that is distension free, said body along the upper side of same being formed to define a planar bearing surface extending thereacross for receiving the rail base bearing surface thereagainst, said body further defining a pair of ridges disposed one on either side of its bearing surface and each including an upright side wall at the marginal edge of the body bearing surface and a lip overhanging the body bearing surface and terminating in a marginal edge projecting over said body bearing surface, said ridge side walls opposing each other and said lip opposing each other across said body bearing surface, said ridge side walls being spaced apart and being of a height to closely receive the rail base therebetween when the rail base engages said body surface, said lips each defining across their upwardly facing sides a convexly contoured cam surface arcing from the crest thereof downwardly into the respective lip marginal edges, said lip marginal edges being spaced apart across said body bearing surface for snap fitting of the rail base side edge surfaces by same for seating the rail base against said body bearing surface said cam surfaces being struck in a radius of approximately twice the distance said lip edges project over said body bearing surface and centered in approximate vertical alignment with the respective cam surface crests and approximately at the level of the upper ends of said ridge side walls.

3. The improvement set forth in claim 2 wherein:
said cam surfaces each define a segment of a cylinder of substantially equal radius.

4. The improvement set forth in claim 2 wherein:
said polymer is a molecularly oriented ultra high molecular weight polyethylene.

5. The improvement set forth in claim 2 wherein:
said polymer is characterized by being flexibly resilient and being resistant to adherence thereto of foreign matter.

6. The improvement set forth in claim 2 wherein:
each of said ridges has one of the spike receiving openings formed therethrough,
said one openings being enlarged down to said upper end levl of said ridge side wall for receiving the spike head for bearing against the rail base when the rail base surface engages said body bearing surface.

7. The improvement set forth in claim 1 wherein:
the tie engaging side of said body is formed to define a plurality of serrations thereacross comprising ridges paralleling said lips and defining angled apexes at their crests for biting engagement with the tie.

8. The improvement set forth in claim 1 including:
a retainer plate extending longitudinally of said tie plate bearing surface,
said retainer plate being proportioned lengthwise of said bearing surface to project beyond either end of said bearing surface,
said retainer plate at each end thereof having a depending flange for seating against either side of the tie.

9. The improvement set forth in claim 8 wherein:
said retainer plate overlies said tie plate bearing surface.

10. The improvement set forth in claim 8 wherein:
said retainer plate underlies said tie plate bearing surface.

11. The improvement set forth in claim 8 wherein:
said retainer plate is formed from said polymer material.

12. The improvement set forth in claim 2 wherein:
said lips are formed for gripping the rail base, when the rail base engages said body surface, under the elastic memory of said polymer material.

13. The improvement set forth in claim 12 wherein:
said body is of one piece construction and said polymer is a molecularly oriented polyethylene having a molecular weight in the range of from about 3,000,000 to about 9,000,000.

14. The improvement set forth in claim 2 wherein:
said plate is resilient for cushioning the rail against the tie.

* * * * *